United States Patent [19]

Christman et al.

[11] 4,016,069

[45] Apr. 5, 1977

[54] MULTIPLE STAGE HYDRODESULFURIZATION PROCESS INCLUDING PARTIAL FEED OIL BY-PASS OF FIRST STAGE

[75] Inventors: Robert D. Christman; Jordan S. Lasher; John A. Paraskos, all of Pittsburgh; Stephen J. Yanik, Valencia, all of Pa.

[73] Assignee: Gulf Research & Development Company, Pittsburgh, Pa.

[22] Filed: Nov. 17, 1975

[21] Appl. No.: 632,375

[52] U.S. Cl. ..... 208/210

[51] Int. Cl.[2] ..... C10G 23/02

[58] Field of Search ..... 208/210, 216

[56] References Cited

UNITED STATES PATENTS

| | | | |
|---|---|---|---|
| 3,206,395 | 9/1965 | Slyngstad et al. | 208/216 |
| 3,425,810 | 2/1969 | Scott, Jr. | 208/216 |
| 3,429,801 | 2/1969 | Gleim et al. | 208/216 |
| 3,617,525 | 11/1971 | Moritz et al. | 208/210 |
| 3,795,607 | 3/1974 | Adams et al. | 208/210 |
| 3,809,644 | 5/1974 | Johnson et al. | 208/210 |

*Primary Examiner*—George Crasanakis

[57] ABSTRACT

A multiple stage process for hydrodesulfurizing a residual oil comprising passing the oil downwardly through a plurality of stages in series with an interstage flashing step. A portion of the fresh feed oil continuously or intermittently by-passes the first stage and flows directly to the second stage.

7 Claims, 4 Drawing Figures

MULTIPLE STAGE HYDRODESULFURIZATION PROCESS INCLUDING PARTIAL FEED OIL BY-PASS OF FIRST STAGE

This invention relates to a process for the hydrodesulfurization of metal- and sulfur-containing asphaltenic heavy oils.

The present invention relates to a multiple stage process for hydrodesulfurizing a residual oil while passing the oil downwardly through a plurality of stages in series with an interstage flashing step. A portion of the feed oil concomitantly on a continuous or intermittent basis by-passes the first stage and flows directly to the second stage. When the fresh feed which is charged directly to the second stage by-passes the first stage feed oil preheater furnace there is a corresponding reduction in first stage oil preheat requirements, in addition to a reduction in first stage catalyst requirements. The fresh feed oil passed to the second stage can be charged to the inlet of the second stage together with first stage effluent or it can be charged to a downstream position in the second stage and thereby serve as a quench for the second stage.

Each reactor of the present process employs a supported Group VI-B and Group VIII metal hydrodesulfurization catalyst. One or more metals from other groups can also be present, such as titanium. Suitable Group VI-B and Group VIII metal combinations include cobalt-molybdenum, nickel-tungsten and nickel-molybdenum. A preferred combination is nickel-cobalt-molybdenum. The catalyst can comprise 5 to 30 weight percent, generally, and 8 to 20 weight percent, preferably, of Group VI-B and Group VIII metals. The remainder of the catalyst generally comprises a highly porous, non-cracking supporting material. Alumina is the preferred supporting material but other porous non-cracking supports can be employed, such as silica-alumina and silica-magnesia. Preferably all or a large proportion of the catalyst particles have a diameter between about 0.025 and 0.05 inch (0.0635 to 0.127 cm), and can be any suitable shape, such as extrudates, granules or spheres. The diameter of a catalyst particle is defined as the smallest surface to surface dimension extending through the center or axis of the particle.

In the present process, the feed oil flows downwardly in each reactor through fixed beds of the catalyst and the series of reactors removes 60, 70, 80 or more weight percent of the feed metals and sulfur from the oil. Very little hydrocracking occurs in the process. Most of the product oil boils above the initial boiling point of the feed oil, generally, and preferably at least 70, 80 or 90 percent of the total product boils above the IBP of the feed oil to the first stage.

The hydrodesulfurization process employs a hydrogen partial pressure of 500 to 5,000 pounds per square inch gauge (35 to 350 kg/cm$^2$), generally, 1,000 to 3,000 pounds per square inch (70 to 210 kg/cm$^2$), preferably, and 1,500 to 2,500 pounds per square inch (105 to 175 kg/cm$^2$), most preferably.

The gas circulation rate can be between 1,000 and 20,000 standard cubic feet per barrel of oil (17.8 and 356 SCM/100L), generally, or preferably about 2,000 to 10,000 standard cubic feet per barrel of oil (35.6 to 178 SCM/100L). The gas circulated preferably contains 80 percent or more of hydrogen. The mol ratio of hydrogen to oil can be between about 4:1 and 80:1. Reactor temperatures can vary between about 600° and 900° F. (316° and 482° C.), generally, and between 650° and 800° F. (343° and 427° C.), preferably. Reactor temperatures are increased during a catalyst cycle to compensate for activity aging loss until a reactor constraint temperature is reached, at which time the catalyst is considered deactivated. The temperature should be sufficiently low so that not more than 30 percent, generally, and preferably not more than about 10, 15 or 20 percent of the 650° F.+ (343° C.+) feed oil will be cracked to material boiling below 650° F. (343° C.). The liquid hourly space velocity in each reactor can be between about 0.1 and 10, generally, and, preferably, between about 0.2 and 1 or 1.25 volumes of oil per hour per volume of catalyst.

The fresh feed to the process of this invention can be a full petroleum crude or a reduced crude containing substantially all of the residual asphaltenes of the full crude. The process is also useful for desulfurizing and demetallizing other asphaltene-containing oils, such as coal liquids and oils extracted from shale and tar sands. Asphaltenes have a relatively low molecular hydrogen to carbon ratio and will generally comprise less than about 10 percent of the feed oil, but will generally contain most of the metallic components present in the total feed, such as nickel and vanadium.

Petroleum atmospheric or vacuum tower residua contain substantially the entire asphaltene fraction of the crude from which they are derived and therefore contain 95 to 99 weight percent or more of the nickel and vanadium content of the full crude. The nickel, vanadium and sulfur content of petroleum residua can vary over a wide range. For example, nickel and vanadium can comprise 0.002 to 0.03 weight percent (20 to 300 parts per million) or more of the residua, while sulfur can comprise about 2 to 7 weight percent, or more, of the residua.

The desulfurization catalysts have a high activity for demetallization as well as for desulfurization and the catalyst removes most of the nickel and vanadium from the feed oil stock as well as most of the sulfur. These metals deposit heavily on the outermost regions of the catalyst particles and tend to inhibit access to catalyst pores, thereby reducing the desulfurization activity of the catalyst. Upon blockage of the pores, the aging rate of the catalyst ceases to be gradual and increases abruptly to terminate the catalyst cycle. Therefore, removed nickel and vanadium generally account for the ultimate deactivation of first stage desulfurization catalysts, while coke deposition during removal of sulfur and nitrogen contributes relatively little to catalyst deactivation in the first stage.

In the context of the present invention, a first stage denotes one or more reactors which precede an interstage flashing step, while a second stage denotes the reactor which follows the interstage flashing step. The hydrogen pressure is sufficiently high so that most of the metals and sulfur are removed from a feed oil in a first stage reactor. In fact, substantially all metals removed can be completed before the feed oil reaches the bottom of a first stage reactor. The oil is then passed to the second stage reactor for removal of the more refractory sulfur. In the second stage, the primary cause of catalyst deactivation is coking. Desulfurization severity is inherently greater in the second stage than in the first stage, and it is known that catalyst coking increases with desulfurization severity. Catalyst coking occurs so extensively in a second hydrodesulfurization stage that the second stage aging rate is considerably more rapid than the first stage aging rate. In prior art two-stage residual oil hydrodesulfurization processes employing non-promoted catalysts with an interstage flash for removal of contaminant by-product gases, such as hydrogen sulfide, ammonia and gaseous hydrocarbons, and with progressively increasing temperatures in each stage to compensate for catalyst aging, it is commonly known that both the catalyst aging rate and coke formation on the catalyst is considerably greater in the second stage than in the first stage. Although the interstage removal of hydrogen sulfide and ammonia is desirable since these materials are reaction products, the lack of these materials in a downstream stage is detrimental to catalyst activity and contributes to downstream catalyst coking. This high second stage coking phenomenon can also probably be explained on a molecular basis. In the first stage, the existence of peripheral alkyl groups on feed asphaltene and resin molecules provides steric hindrance which tends to prevent contact of the polycondensed ring inner body of the residual molecules with the catalyst. However, the most refractory sulfur in the asphaltene molecules is not removed in the first stage and must be removed in a second stage. This sulfur is more refractory because it tends to be deeply imbedded in the aromatic nucleus. Following the elimination of some of the alkyl groups in the first stage, the molecules entering the second stage are sterically better adapted to permit the aromatic nucleus to abut broadly against catalyst sites exposing the hydrogen and carbon atoms and ultimately the imbedded sulfur more intimately to the catalyst surface, thereby inducing coking. This mechanism probably accounts for the enhanced catalyst coking and higher aging rates in the second stage, as compared to the first stage.

The present invention is illustrated in the attached figures in which

Figure 1:
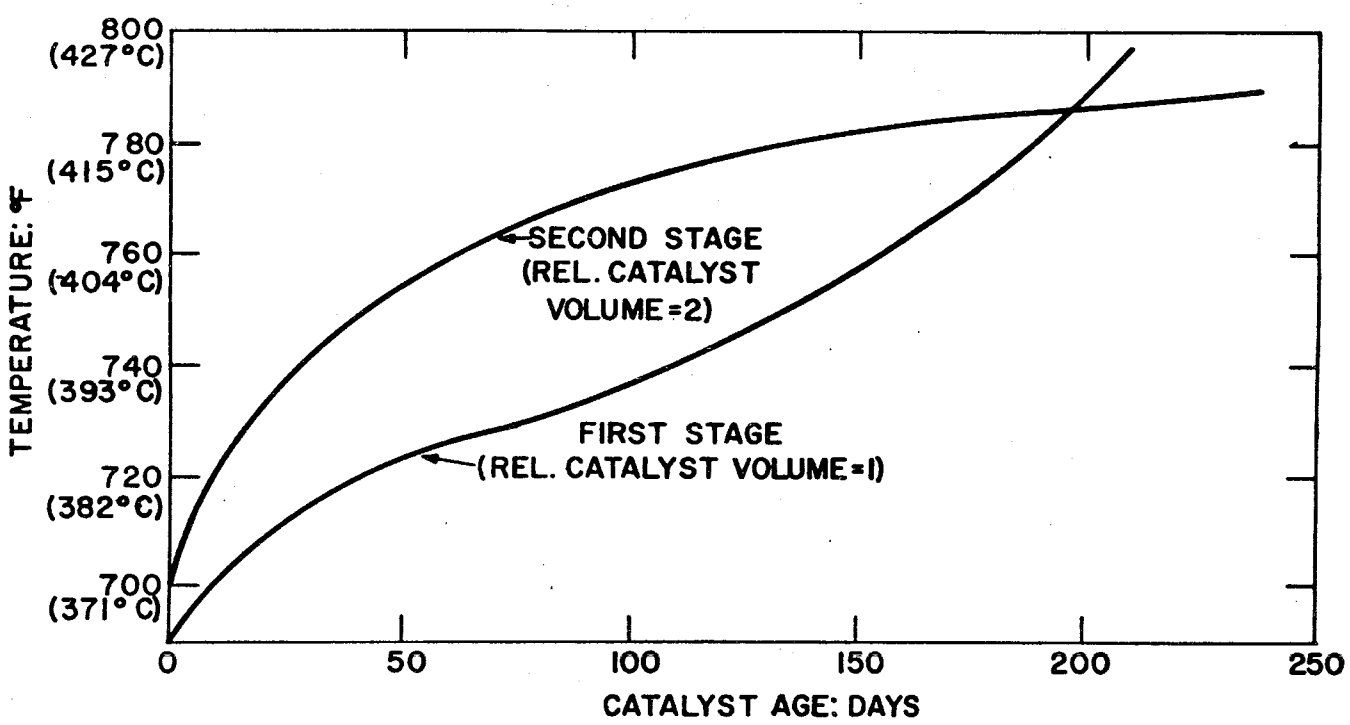
FIGS. 1, 2 and 3 show catalyst aging curves.

FIG. 1 presents aging curves for first and second stages in series of a downflow petroleum residual oil hydrodesulfurization process with an interstage flashing step to remove contaminant gases wherein both reactors have a common metallurgy constraint temperature of about 790° F. (421° C.). Both reactors contain a fixed bed of stationary catalyst particles. The lower curve represents the first stage aging characteristics of a nickel-cobalt-molybdenum on alumina catalyst in desulfurizing a 650° F.+ (343° C.+) Kuwait residual oil from 4 to 1 weight percent sulfur at a relative LHSV of 1.0 over the full aging period until the constraint temperature of 790° F. (421° C.) is reached. After flashing of hydrogen-containing gaseous impurities, including hydrogen sulfide, ammonia, gaseous and some low boiling liquid hydrocarbons, and subsequent addition of fresh hydrogen, the flash residue of the first stage hydrodesulfurization step is hydrodesulfurized in a second stage to reduce its sulfur content from 1 to 0.3 weight percent. The upper curve of FIG. 1 represents the second stage aging curve over the full aging period until the 790° F. (421° C.) constraint temperature is reached. The weight of catalyst employed in the second stage was twice that employed in the first stage reflecting the greater difficulty of the second stage operation due to the lower concentration of sulfur and the more refractory nature of the sulfur being removed in the second stage, as well as the removal in the interstage flashing step of catalyst activating materials such as ammonia and hydrogen sulfide. Even though a total of about 3 weight percent sulfur was removed in the first stage while a total of only about 0.7 weight percent sulfur was removed in the second stage, and even though the second stage utilized twice as much catalyst as the first stage, FIG. 1 shows that throughout the catalyst aging cycle a considerably higher temperature was required in the second stage as compared to the first stage due to a much greater rate of coke deposition on the second stage catalyst as compared to the first stage catalyst.

Figure 2:
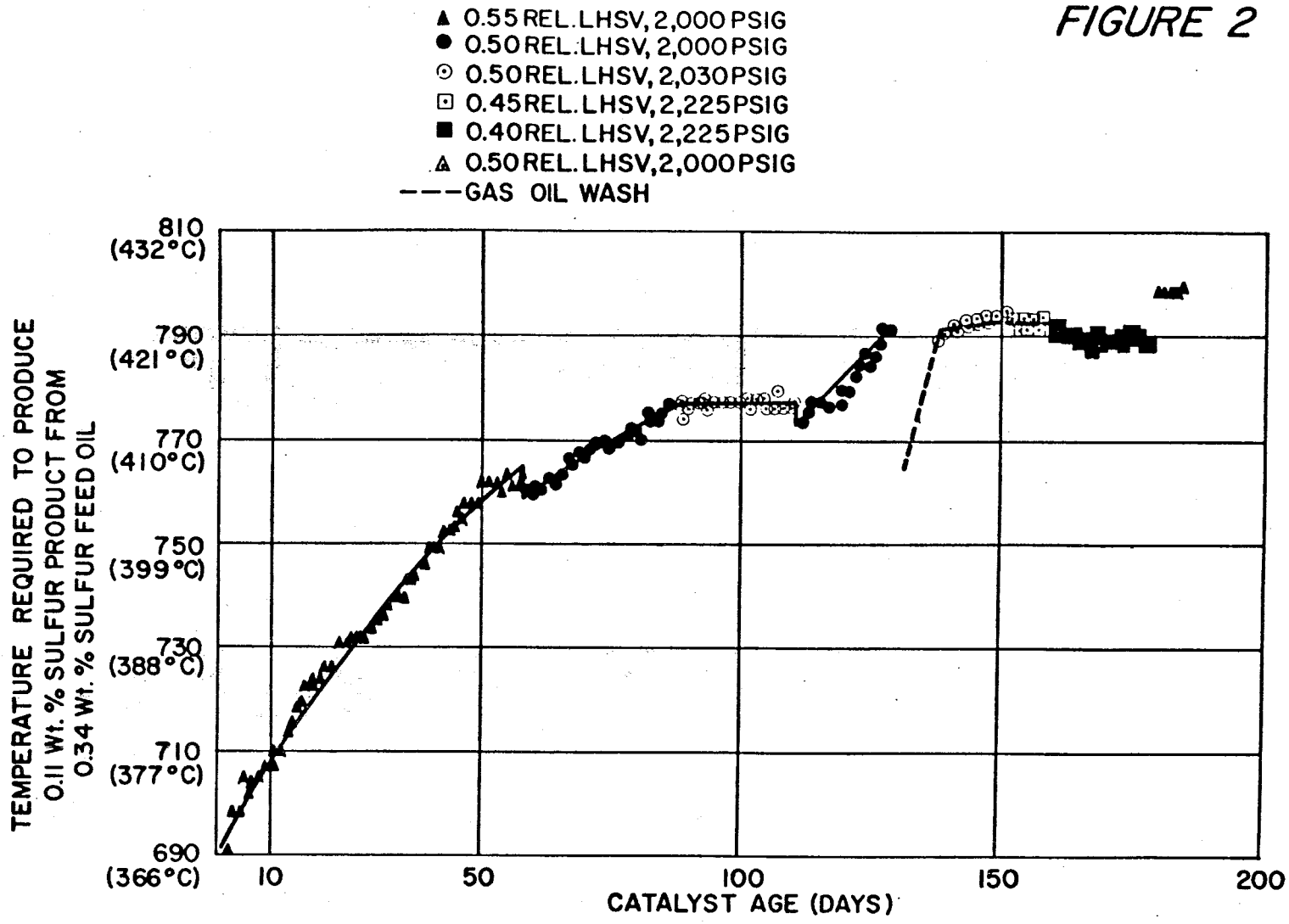

FIG. 2 presents a more detailed picture of a late stage petroleum residual oil hydrodesulfurization aging curve, specifically a third stage aging curve, using a nickel-cobalt-molybdenum on alumina catalyst. In the test illustrated in FIG. 2, although there was a flash step between the first and second stages, there was no flash step between the second and third stages. The stage represented in the data of FIG. 2 produced a product containing 0.11 weight percent sulfur from an effluent from a second stage containing 0.34 weight percent sulfur at 1850 psi (130 kg/cm$^2$) hydrogen pressure and 5,000 SCF/B (89 SCM/100L) of a stream containing 85 percent hydrogen. As shown in FIG. 2, due to rapid catalyst aging and rapid approach of the 790° F. (421° C.) reactor constraint temperature, process severity required incremental amelioration in order to keep the reactor in operation until earlier stages also reached the constraint temperature, as indicated by step-wise reductions in relative space velocity from 0.55 to 0.50, to 0.45, and to 0.40, while sulfur compounds were added in all but the first two space velocity intervals indicated in FIG. 2 to maintain the catalyst in a sulfided condition in the face of the low quantity of sulfur removed in the reactor. FIG. 2 shows that at the end of the aging period a relative space velocity of 0.50 was attempted, but at this space velocity at the last period in the catalyst cycle the constraint temperature had to be exceeded in order to achieve the desired product sulfur level. Such a situation ordinarily requires termination of the catalyst cycle.

Figure 3:
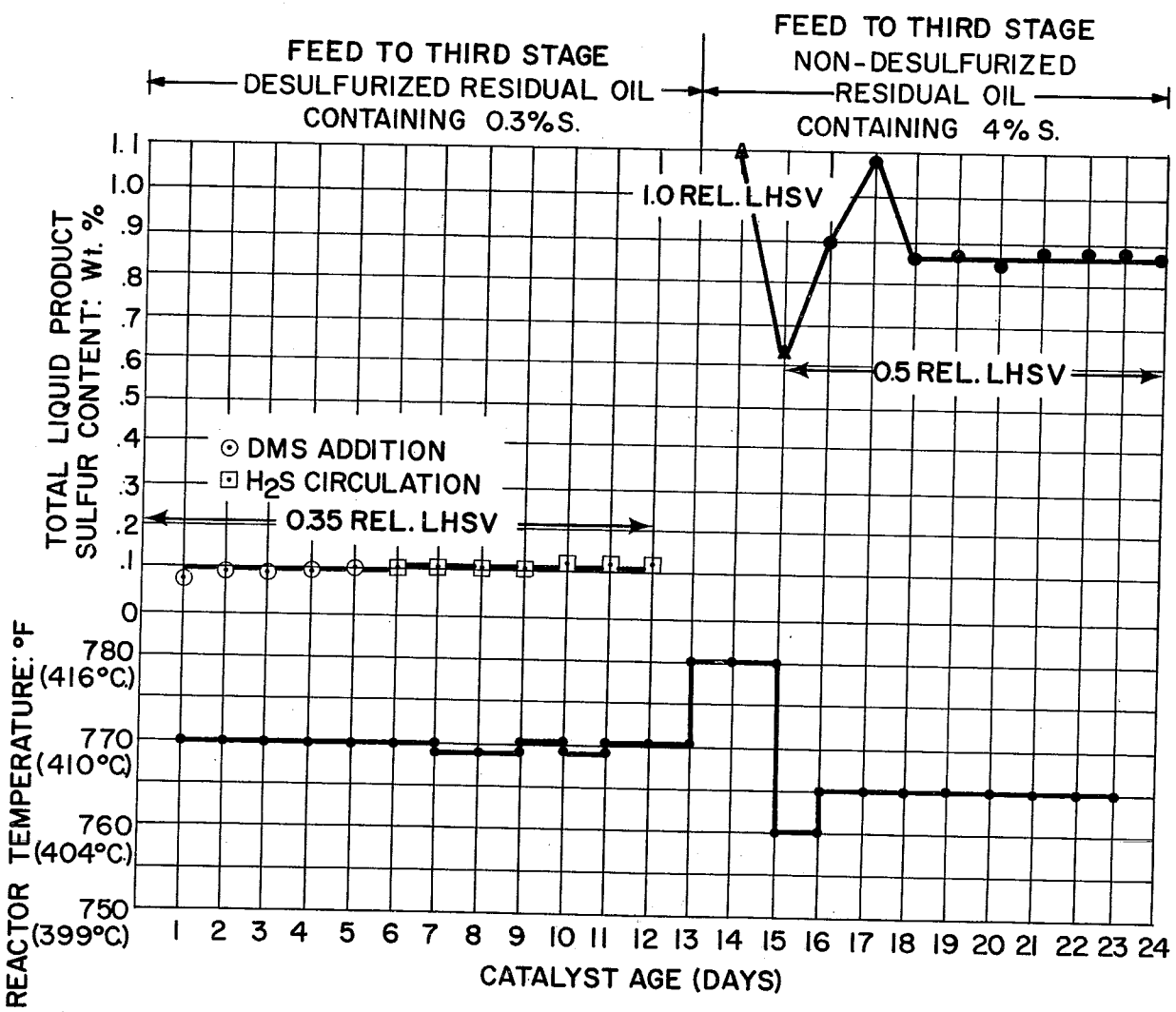

FIG. 3 represents an extension of the petroleum aging curve of FIG. 2. In order to attempt an extension of the life of the third stage catalyst, the relative LHSV was lowered drastically to 0.35 and dimethyl sulfide or hydrogen sulfide was added, permitting production of a 0.1 weight percent sulfur product at only 770° F. (371° C.). However, this space velocity was totally inadequate for processing a volume of oil as would be required with the reactor in series with earlier reactor stages. Thereupon, a fresh non-desulfurized petroleum residual oil stream containing 4 weight percent sulfur which had constituted the feed to the first desulfurization stage was charged directly to the third stage. Initially, the non-desulfurized stream was introduced at a relative LHSV of 1.0, and a product sulfur level of 1.1 was obtained at 780° F. (416° C.). Since this temperature is close to the 790° F. (421° C.) constraint temperature, the relative LHSV was lowered to 0.5 and a product containing 0.86 percent sulfur was obtained at a reactor temperature of only 760° F. (404° C.). In this manner, the third stage reactor, after it was completely deactivated for third stage purposes, was found to be capable of desulfurizing the full flow rate of oil that had been charged to the first stage to obtain a product sulfur level of less than the 1 percent sulfur level obtained from the first stage with the same feed. Furthermore, FIG. 3 shows that at a steady temperature of 765° F. (407° C.), which is well below the 790° F. (421° C.) metallurgical constraint temperature of the reactor, this surprising result is achieved with no catalyst aging during the period of the test, even though the catalyst had previously been completely coke deactivated for purposes of standard third stage operation.

A possible theory relating to the data of FIG. 3 is that passage of fresh feed residual oil over a coke-deactivated catalyst in a downstream reactor induces a reduction of the equilibrium coke level on the downstream deactivated catalyst, even though there is no intervention of an oxidation or other type of catalyst regeneration step.

In accordance with the present invention, the discovery of the capacity of a residual oil feed to extend the life of a second or third stage residual oil hydrodesulfurization catalyst after it has been completely deactivated by coke is applied to the utilization of a residual oil feed to increase the onstream factor of a second or third stage catalyst prior to occurrence of complete deactivation. According to the present invention, a portion of the fresh residual feed oil continuously or intermittently by-passes the first stage, and preferably also by-passes the first stage oil preheater, and flows directly into a second series stage together with first stage effluent, and/or it flows directly into a third series stage together with second stage effluent. In this manner, the effect of the fresh feed can be continuously or intermittently exerted throughout a catalyst cycle so that instead of extending the life of a fully deactivated second or third stage catalyst at the termination of a catalyst cycle, it exerts a comparable effect at an earlier time in a catalyst cycle by inhibiting the rate of deactivation of the second or third stage cycle while the catalyst cycle is still in progress.

As indicated above, since the life of a second or third stage catalyst is coke-limited, the fresh non-desulfurized feed oil may induce a reduction in the equilibrium coke level on the catalyst. Similarly, when fresh non-hydrodesulfurized feed oil is blended with previously hydrodesulfurized oil its inhibition on the rate of deactivation of a downstream catalyst may be due to its maintaining a lower equilibrium coke level on the catalyst as compared to the equilibrium coke level that would prevail during hydrodesulfurization of the same effluent oil from an earlier hydrodesulfurization stage in the absence of fresh feed oil. The fresh feed may maintain a relatively low catalyst equilibrium coke level because it is a richer source of ammonia and hydrogen sulfide than a previously hydrodesulfurized oil, both of which materials are required for maintaining catalyst stability. This effect is the subject of U.S. Pat. No. 3,860,511. Also, the fresh feed oil constitutes a richer source of highly aromatic material than previously hydrotreated oil, and catalytic coke tends to be most soluble in an oil which is highly aromatic. The reason for the compatibility of carbon with aromatic oil is that both have a relatively low hydrogen to carbon ratio. The by-pass of a portion of process fresh feed oil into a second or third series reactor stage provides the auxiliary advantage of tending to either reduce the amount of first stage catalyst required or to extend the life of the first stage catalyst, which life is metals-limited, by relieving the first stage catalyst of some of its metals-removing load. Although the metals in the by-passed fresh feed oil are deposited on the downstream catalyst, this does not seriously diminish the life of the downstream catalyst since its life is coke-limited and not metals-limited. If desired, in order for the process to produce an effluent oil of undiminished sulfur level while by-passing a portion of the fresh feed around the first stage directly to a downstream stage, a portion of the downstream effluent can be recycled to the first stage reactor.

As stated above, in this invention a first stage denotes one or more reactors which precede an interstage flash step, while a second stage denotes the reactor which follows an interstage flash step. Each reactor operates downflow so each contains a fixed bed of stationary catalyst particles. As used herein, a third stage is the second reactor following an interstage flashing step. Most of the metals and sulfur are removed from a feed oil in a first stage reactor. The oil is then passed to the second stage reactor for removal of the more refractory sulfur. As indicated above, in the second and third stages the primary cause of catalyst deactivation is coking. It is well known that catalyst coking increases with desulfurization severity. Catalyst coking occurs so extensively in a second hydrodesulfurization stage that, as shown in FIG. 1, the second stage aging rate is considerably more rapid than the first stage aging rate.

An advantage in two-stage operation is to be expected because the interstage flashing step removes hydrogen sulfide, ammonia and light hydrocarbons, permitting an elevated second stage hydrogen partial pressure. However, some ammonia and hydrogen sulfide are required to stabilize the second stage catalyst against coking, but frequently fresh hydrogen sulfide and ammonia are not adequately produced in the second stage since most of the sulfur and nitrogen in the feed oil is removed in the first stage. It is believed that ammonia is required to partially moderate catalyst acidity, while hydrogen sulfide is required to maintain control of the active presulfided state of the catalyst. The fresh feed by-pass method of the present invention advantageously provides a ready source of fresh hydrogen sulfide and ammonia to maintain catalyst activity and sufficient fresh feed oil should be by-passed to the second stage to provide the hydrogen sulfide and ammonia requirements for the second stage catalyst that cannot be provided by the first stage effluent oil.

Figure 4:
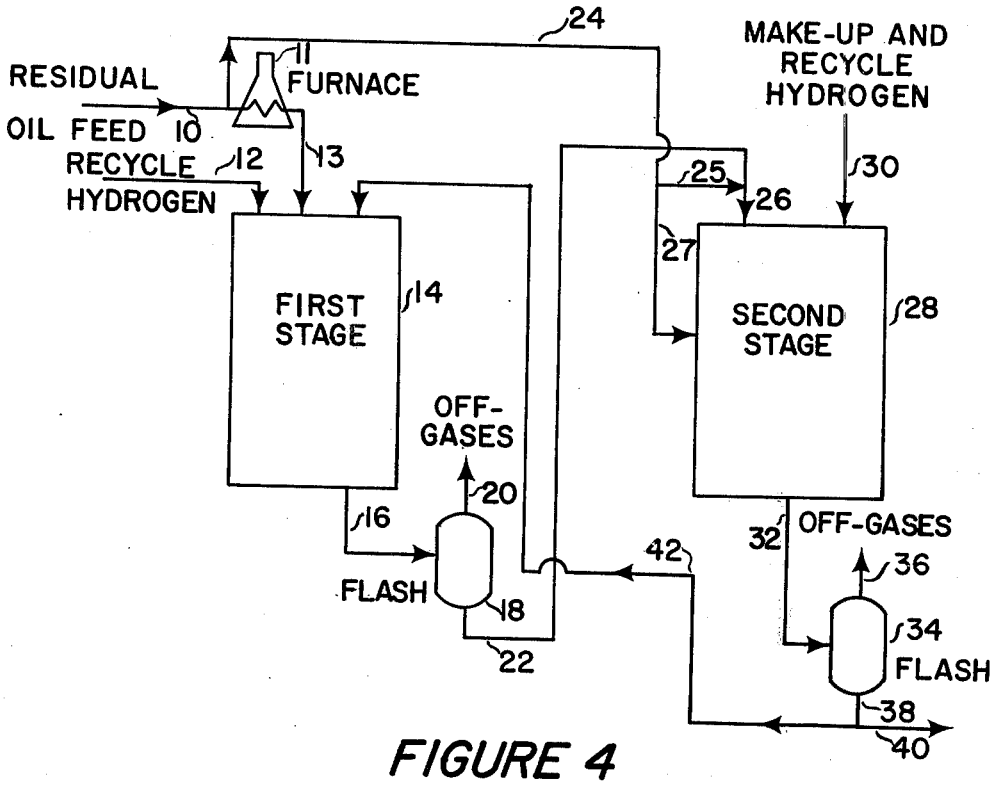
FIG. 4 shows a process scheme for performing the present invention.

A process for performing the fresh feed by-pass operation is illustrated in FIG. 4. As shown in FIG. 4 fresh residual oil feed entering through line 10 and preheater furnace 11 together with recycle hydrogen entering through line 12 are passed to a first stage hydrodesulfurization reactor 14. First stage effluent leaves reactor 14 through line 16 and enters flash chamber 18, from which offgases containing hydrogen sulfide, ammonia, and light hydrocarbons in addition to hydrogen are discharged through line 20, while a heavy oil is removed through line 22.

The first stage effluent in line 22 is admixed with a non-preheated by-pass stream of fresh residual oil passing through lines 24 and 25 to form a blend in line 26 which enters the second hydrodesulfurization stage 28. Make-up and recycle hydrogen enters second stage 28 through line 30. It is preferred to charge process make-up hydrogen to the second stage 28 rather than to the first stage 14 in order to have a richer stream of hydrogen entering the second stage than the first stage. Make-up hydrogen has a higher hydrogen purity than recycle hydrogen. By charging the richest hydrogen stream to the second stage rather than to the first stage, the maximum advantage of the flashing step is obtained, which is elevation of hydrogen partial pressure. Also, this permits the richest source of hydrogen to be available in the reactor experiencing the greatest coking problem.

Second stage effluent leaves reactor 28 through line 32 and enters flash chamber 34. Off-gases are removed from flash chamber 34 through line 36 and heavy oil is removed through line 38. Most of the heavy oil is removed as product through line 40. If desired, a portion of the second stage effluent can be recycled to the first stage reactor 14 through line 42. The quantity of recycled oil in line 42 can be about equal to the quantity of by-pass fresh feed in line 24. Recycle line 42 is employed as an optional feature, when it is desired to maintain the process effluent oil in line 40 at a sulfur level which is no higher than would prevail in the absence of employment of the by-pass fresh feed stream in line 24.

If desired, a portion of the by-pass residual oil in line 24 can be charged through line 27 to a downstream position in second stage reactor 28 to serve as a quench for the second stage. In this manner, the cool non-preheated by-pass residual oil feed not only reduces heat requirements in furnace 11 by by-passing furnace 11 but also serves as a quench in second stage reactor 28.

We claim:

1. A process for hydrodesulfurization of a metal- and sulfur-containing asphaltenic feed oil comprising passing said oil and hydrogen downwardly through both first and second catalytic hydrodesulfurization stages in series, the catalyst in said stages comprising supported sulfided Group VI-B and Group VIII metals, said stages operated at a temperature of 600° to 790° F. and a hydrogen pressure of 500 to 5,000 psi, flashing contaminant gases including hydrogen sulfide and ammonia from the oil flowing between said stages, and concomitantly by-passing a portion of said feed oil around said first stage and charging it directly into said second stage.

2. A process for the hydrodesulfurization of a metal- and sulfur-containing asphaltenic feed oil comprising passing said oil through a preheater, passing preheated oil and hydrogen downwardly through first and second catalytic hydrodesulfurization stages in series, the catalyst in said stages comprising supported sulfided Group VI-B and Group VIII metals, said stages operated at a temperature of 600° to 790° F. and a hydrogen pressure of 500 to 5,000 psi, flashing contaminant gases including hydrogen sulfide and ammonia from the oil flowing between said stages, and concomitantly by-passing a portion of said feed oil around said preheater and said first stage and charging it directly into said second stage.

3. The process of claim 2 wherein said by-passed feed oil is charged into said second stage at the upstream end thereof.

4. The process of claim 2 wherein said by-passed feed oil is charged into said second stage at an intermediate position therein.

5. The process of claim 2 wherein desulfurized oil product is removed from said second stage and a portion of said oil product is recycled to said first stage.

6. The process of claim 2 wherein desulfurized product oil is removed from said second stage and a portion of said product oil is recycled to said first stage, the amount of said recycled product oil being substantially equal to the amount of said by-passed feed oil.

7. The process of claim 1 wherein not more than about 20 percent of the 650° F.+ material in said feed oil is cracked to material boiling below 650° F.

* * * * *